US007677252B2

(12) United States Patent
Mashino et al.

(10) Patent No.: US 7,677,252 B2
(45) Date of Patent: Mar. 16, 2010

(54) CIGARETTE MANUFACTURING APPARATUS WITH AN IN-LINE FLAVORING DEVICE

(75) Inventors: Shigemi Mashino, Tokyo (JP); Keisuke Minami, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 469 days.

(21) Appl. No.: 11/798,871

(22) Filed: May 17, 2007

(65) Prior Publication Data

US 2007/0277838 A1 Dec. 6, 2007

Related U.S. Application Data

(63) Continuation of application No. PCT/JP2005/018565, filed on Oct. 6, 2005.

(30) Foreign Application Priority Data

Nov. 19, 2004 (JP) ..... 2004-336240

(51) Int. Cl.
*A24C 5/24* (2006.01)

(52) U.S. Cl. ..... 131/68; 131/69; 118/325

(58) Field of Classification Search ..... 131/68, 131/69; 118/325
See application file for complete search history.

(56) References Cited

U.S. PATENT DOCUMENTS

| | | | | |
|---|---|---|---|---|
| 3,039,908 | A * | 6/1962 | Parmele | 156/200 |
| 4,721,119 | A | 1/1988 | Ludszeweit et al. | |
| 5,129,409 | A * | 7/1992 | White et al. | 131/364 |
| 2001/0003890 | A1 | 6/2001 | Preisner et al. | |
| 2004/0005975 | A1 | 1/2004 | Garthaffner et al. | |
| 2004/0118416 | A1 | 6/2004 | Seymour et al. | |
| 2004/0151392 | A1 | 8/2004 | Miyakoshi et al. | |

FOREIGN PATENT DOCUMENTS

| | | | |
|---|---|---|---|
| JP | 9-97674 | A | 4/1997 |
| JP | 2000-270831 | A | 10/2000 |
| JP | 2003-27395 | A | 1/2003 |
| JP | 2003-169655 | A | 6/2003 |
| RU | 2 218 063 | C2 | 12/2001 |
| SU | 664533 | A3 | 5/1979 |
| SU | 1295992 | A3 | 3/1987 |
| WO | WO-03/013284 | A1 | 2/2003 |
| WO | WO-2004/002726 | A1 | 1/2004 |

* cited by examiner

*Primary Examiner*—Carlos Lopez
(74) *Attorney, Agent, or Firm*—Birch, Stewart, Kolasch & Birch, LLP

(57) ABSTRACT

A cigarette manufacturing apparatus has an applicator that is interposed in a wrapping paper supply path for continuously supplying wrapping paper to a hoist and applies an aroma chemical to the wrapping paper, a high-frequency dielectric heating device that is installed in the applicator and dries the wrapping paper applied with the aroma chemical, and a warm air blower that supplies warm air to the inside of the high-frequency dielectric heating device and dehumidifies the inside of the device. Particularly, used as the high-frequency dielectric heating device is one that has one or more electrode pairs arranged opposite each other at a prescribed distance and applied with a high-frequency voltage in a range of from 10 to 100 MHz, and applies a high-frequency electric field to the wrapping paper introduced to between the electrodes to dielectrically heat the wrapping paper, so that the wrapping paper is provided to cigarette production after the aroma chemical applied to the wrapping paper is properly dried.

4 Claims, 5 Drawing Sheets

CIGARETTE MANUFACTURING APPARATUS WITH AN IN-LINE FLAVORING DEVICE

This application is a Continuation of copending PCT International Application No. PCT/JP2005/018565 filed on Oct. 6, 2005, which designated the United States, and on which priority is claimed under 35 U.S.C. § 120. This application also claims priority under 35 U.S.C. § 119(a) on Patent Application No(s). 2004-336240 filed in Japan on Nov. 19, 2004. The entire contents of each of the above documents is hereby incorporated by reference.

TECHNICAL FIELD

The present invention relates to a cigarette manufacturing apparatus that produces cigarettes while applying an aroma chemical to long wrapping paper that is continuously supplied to a hoist.

BACKGROUND ART

A hoist used in cigarette production is disclosed in detail, for example, in US 2004/0118416 A1. This hoist transfers long wrapping paper, which is continuously supplied, in the longitudinal direction while maintaining the paper by using garniture tape, and simultaneously places the tobacco shreds controlled in its supply amount on the upper surface of the wrapping paper. Both the edge portions of the wrapping paper are curved in the width direction to wrap the tobacco shreds continuously. By so doing, a long rod-like cigarette is continuously produced. In this process, one of the edge portions of the wrapping paper that is continuously supplied to the hoist is applied with seam glue for bonding together the edge portions of the wrapping paper that wraps the tobacco shreds.

The long rod-like cigarette that is continuously produced as described above is cut into pieces having prescribed length at the outlet of the hoist. The cigarettes are then supplied to a filter tip attachment as the next step, and filter tips are coaxially fixed to the ends of the cigarettes.

It has recently been attempted to apply an aroma chemical onto the wrapping paper for the purpose of suppressing a certain odor component in cigarettes without ruining the flavor of the cigarettes. An aroma chemical of this kind is diluted, for example, with CMC (carboxymethyl cellulose) solution. This aroma chemical is generally high in moisture content as compared to the seam glue. Therefore, if the wrapping paper applied with the aroma chemical is supplied to the hoist in the undried state, this easily causes the problems that the wrapping paper winds around guide rollers in the hoist and that the wrapping paper sticks to a guide member to incur jamming of the wrapping paper. For this reason, the wrapping paper applied with the aroma chemical needs to be supplied to the hoist after being completely dried.

There is a tendency to increase the production rate of cigarettes in the hoist more and more, so that it is difficult to secure sufficient time for drying the wrapping paper applied with an aroma chemical. In case that a radiant heat source, such as a halogen lamp (infrared ray lamp) and a rod heater, which is generally used to dry seam glue, is utilized, only the surface is mainly heated, so that the drying is prone to be incomplete. Moreover, the wrapping paper easily gets stained on the surface. In contrast, if a microwave heating device using electromagnetic waves is utilized, scorching caused by electric discharge occurs frequently, and in some cases the wrapping paper is burned. Possible causes of these problems are high moisture content in the aroma chemical, rapid water infiltration attributable of the thinness of the wrapping paper, and small dry load.

DISCLOSURE OF THE INVENTION

It is an object of the present invention to provide a cigarette manufacturing apparatus capable of applying an aroma chemical to wrapping paper that is continuously supplied to a hoist and of properly drying the aroma chemical applied to the wrapping paper.

Specifically, an object of the present invention is to provide a cigarette manufacturing apparatus that is suitable to continuously supply long wrapping paper at high rate according to working speed of the hoist and has a function of drying the applied aroma chemical.

In order to achieve the above objects, the cigarette manufacturing apparatus according to the present invention is characterized by including:

<a> a hoist that bends long wrapping paper in a width direction and continuously wraps tobacco shreds;

<b> a wrapping paper supplying device that continuously supplies the wrapping paper to the hoist;

<c> an applicator that is interposed in a wrapping paper supply path between the wrapping paper supplying device and the hoist and applies an aroma chemical to the wrapping paper;

<d> a high-frequency dielectric heating device that is installed in the applicator and dries the wrapping paper applied with the aroma chemical; and <e> a warm air blower that supplies warm air to the inside of the high-frequency dielectric heating device and dehumidifies the inside of the device.

The applicator is embodied to include an application nozzle for applying the wrapping paper with an aroma chemical diluted, for example, with CMC (carboxymethyl cellulose) solution, and a controller for controlling amount of the aroma chemical applied to the wrapping paper by the application nozzle, according to supply speed of the wrapping paper to the hoist.

The high-frequency dielectric heating device preferably, for example, has one or more electrode pairs arranged opposite each other at a prescribed distance and applied with high-frequency voltage, and applies a high-frequency electric field to the wrapping paper introduced to between the electrodes to dielectrically heat the wrapping paper. It is preferable that the electrode pairs be driven by being applied with a high-frequency voltage in a range of from 10 to 100 MHz.

The cigarette manufacturing apparatus according to the present invention sends warm air to the inside of the high-frequency dielectric heating device to dehumidify the inside of the device, and simultaneously dielectrically heats and dries the aroma chemical applied to the wrapping paper by means of the high-frequency dielectric heating device. This makes it possible to efficiently evaporate moisture contained in the aroma chemical while suppressing generation of electric discharge between the electrodes of the high-frequency dielectric heating device, and to properly dry the aroma chemical and the wrapping paper. In other words, the apparatus evaporates the moisture from the inside of the aroma chemical through the use of heat generation caused by dielectric loss of the moisture (dielectric material) contained in the aroma chemical by applying the high-frequency electric field to the wrapping paper applied with the aroma chemical, to thereby eliminate the moisture evaporated from the aroma chemical by using warm air. Accordingly, the aroma chemical and the wrapping paper can be efficiently properly dried without incurring troubles such as electric discharge between the electrodes.

With the cigarette manufacturing apparatus according to the present invention, it is easy to reliably perform the drying operation by increasing the strength of the high-frequency electric field, for example, according to the speed at which the wrapping paper is supplied to the hoist even if cigarettes are manufactured at a high rate of about 10,000 to 20,000 cigarettes/minute, for example. Consequently, the apparatus is very favorable to the drying operation performed while the amount of the aroma chemical to be applied to the wrapping paper is controlled according to the cigarette production rate (so-called hoisting speed).

BEST MODE OF CARRYING OUT THE INVENTION

A cigarette manufacturing apparatus according to one embodiment of the present invention, and more specifically a cigarette manufacturing apparatus that produces cigarettes at high rate while applying an aroma chemical to wrapping paper P will be described below with reference to drawings.

Figure 1:
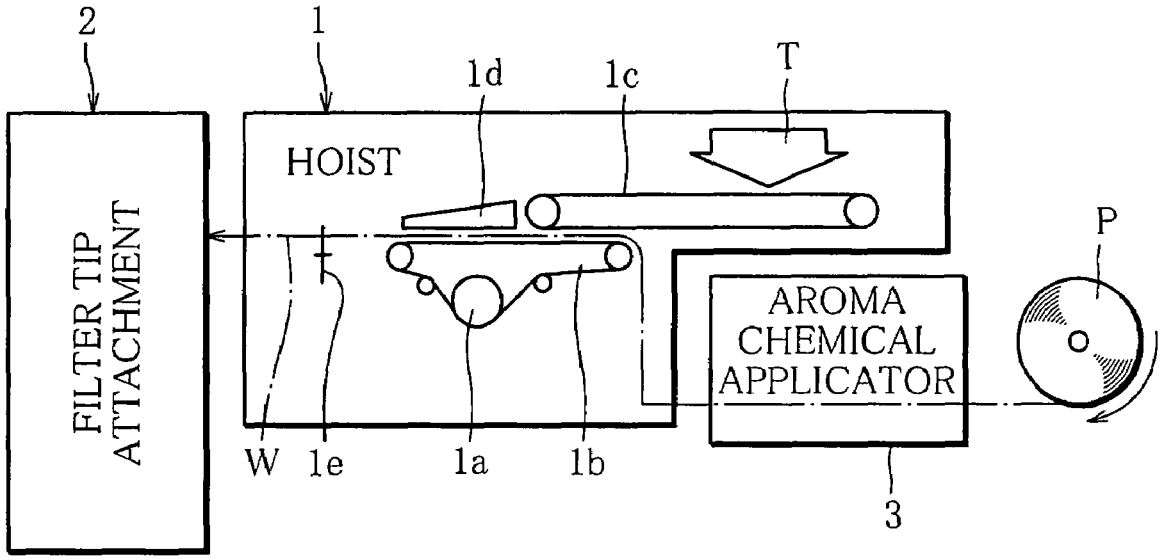
FIG. 1 is a view showing an entire schematic configuration of a cigarette manufacturing apparatus according to one embodiment of the present invention.

Roughly speaking, as illustrated in FIG. 1 showing an entire schematic configuration thereof, the cigarette manufacturing apparatus produces a long rod-like cigarette by bending long wrapping paper P in a width direction and continuously wrapping tobacco shreds T. The apparatus has a hoist 1 that cuts the cigarette into pieces having prescribed length and outputs them, and a filter tip attachment 2 that attaches filter tips to end portions of the cigarettes having the prescribed length, which are sequentially supplied from the hoist 1.

The hoist 1 is introduced in detail in Japanese Patent No. 3372162. The hoist 1, by using garniture tape 1*b* that is delivered while being controlled in speed by a main spindle 1*a*, continuously wraps tobacco shreds T supplied in a state sucked onto a lower face of a delivery belt 1*c* in the long wrapping paper P that is continuously supplied while being wound off from a roll, to thereby produce the cigarette. To be concrete, the hoist 1 bends the wrapping paper P in the width direction thereof using a tongue 1*d* or the like, and at the same time continuously wraps the tobacco shreds T placed on the wrapping paper P, thereby continuously producing a long rod-like tobacco rod. Subsequently, the hoist 1 cuts the tobacco rod into pieces having prescribed length using a cutter 1*e* that is driven in synchronization with rotation of the main spindle 1*a*, and sends the pieces to a filter tip mounter 2 as so-called double cigarettes W, each having twice the length of the length of a cigarette as an end product.

The filter tip attachment 2 is introduced in detail in Japanese Patent No. 2997250. The filter tip attachment 2 divides each of the cigarettes (double cigarettes) W, which are sequentially supplied from the hoist 1, into half in a longitudinal direction thereof, and meanwhile interposes a filter tip F in between the cigarettes coaxially. The filter tip attachment 2 then wraps the cigarettes and filter tip F in tip paper, to thereby couple and unite them into one. Thereafter, the filter tip attachment 2 cuts the filter tip F integrated with the cigarettes at the center, to thereby produce two filter cigarettes having the filter tips F fixed to respective end portions at a time.

Basically, in the cigarette manufacturing apparatus having the hoist 1 and the filter tip attachment 2, the present invention is characterized by including an aroma chemical applicator 3 for applying an aroma chemical to the wrapping paper P, which is interposed in a supply path of the long wrapping paper P that is wound off from the roll and supplied to the hoist 1 by a well-known wrapping paper supplying device. The aroma chemical applicator 3 removes certain odor components contained in so-called sidestream smoke or applies the wrapping paper P with an aroma chemical for shielding the certain odor components. The aroma chemical applicator 3 has a function of drying the aroma chemical applied to the wrapping paper P as described below.

Figure 2:
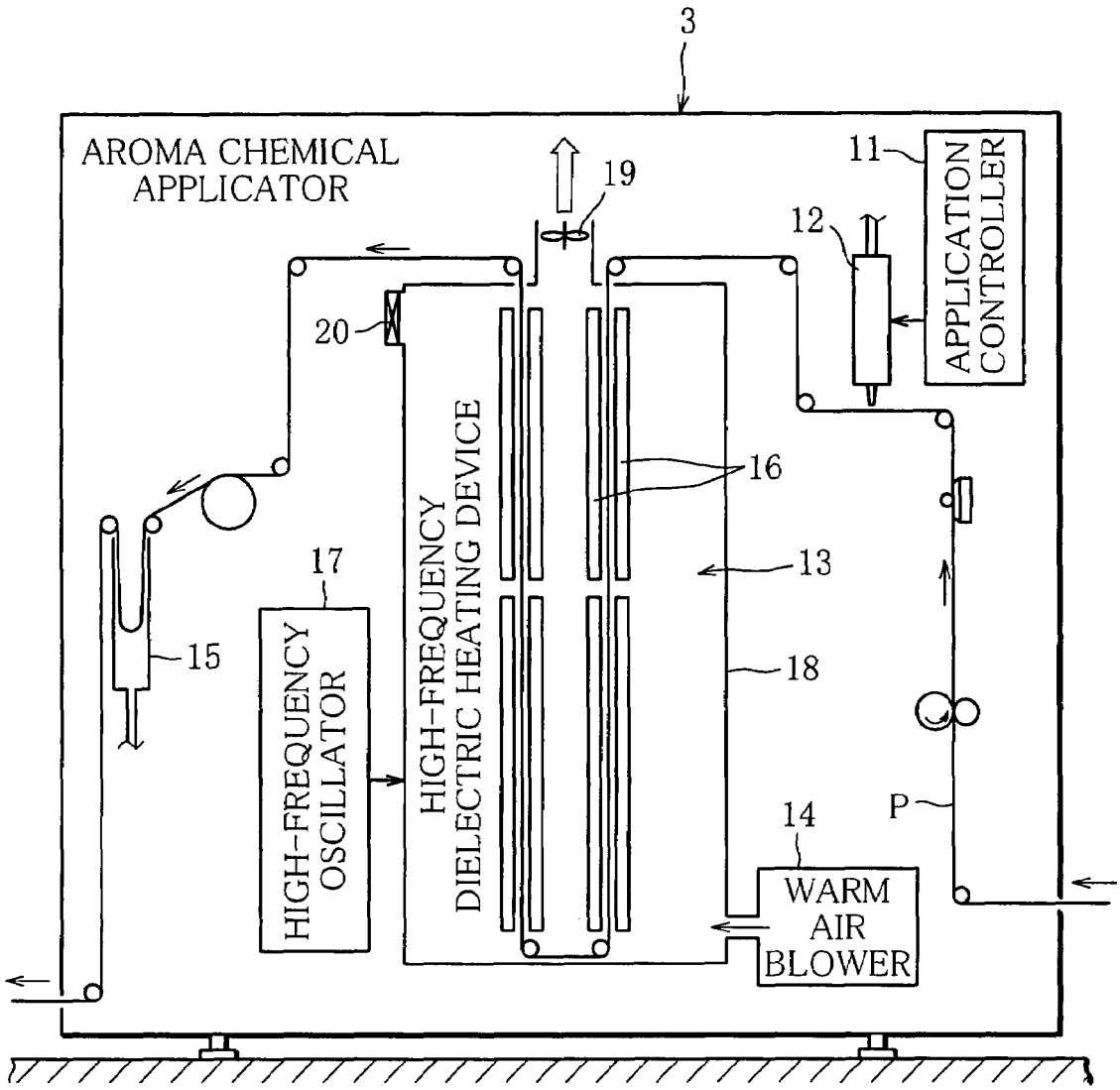
FIG. 2 is a view showing an example of a configuration of an aroma chemical applicator that is a characterizing constituent of the cigarette manufacturing apparatus according to the present invention.

FIG. 2 shows a schematic configuration of the aroma chemical applicator 3. The aroma chemical applicator 3 has an application nozzle 12 for applying the aroma chemical to the wrapping paper P that is continuously supplied to the hoist 1 while being controlled by an application controller 11, a high-frequency dielectric heating device 13 that is disposed downstream of the application nozzle 12 and dries the wrapping paper P applied with the aroma chemical, and a warm air blower 14 that supplies warm air to the inside of the high-frequency dielectric heating device 13 and dehumidifies the inside of the heating device 13. The aroma chemical applicator 3 delivers the wrapping paper P that has been dried by the high-frequency dielectric heating device 13 toward the hoist 1 at prescribed rate after absorbing extra slack of the paper P using a reservoir 15.

The high-frequency dielectric heating device 13 has a plurality of electrode pairs 16 arranged opposite each other at a prescribed distance across a travel line for the wrapping paper P, which is formed in the device 13. Each of the electrode pairs 16 is driven by being applied with a high-frequency voltage of about 40 MHz, for example, by means of a high-frequency oscillator 17. The electrode pairs 16 act to apply a high-frequency electric field to the wrapping paper P traveling between the electrode pairs 16. The wrapping paper P applied with the aroma chemical is dielectrically heated by the high-frequency electric field applied by each of the electrode pairs 16. Concretely, the contained moisture is emitted by self-heating along with loss of dielectric material of the applied high-frequency electric field, to thereby dry the aroma chemical.

Figure 3:
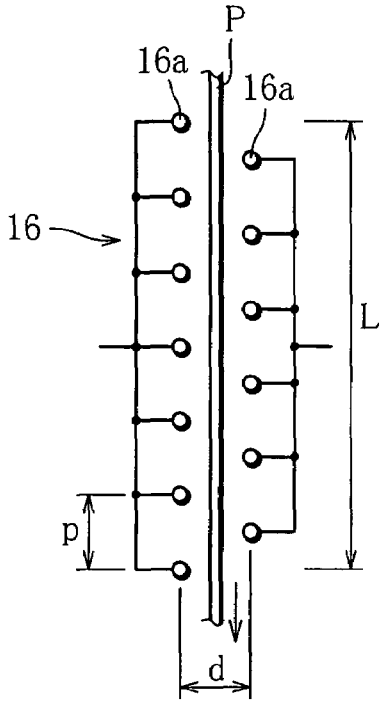
FIG. 3 is a front view showing arrangement of electrode pairs in a high-frequency dielectric heating device.
Figure 4:
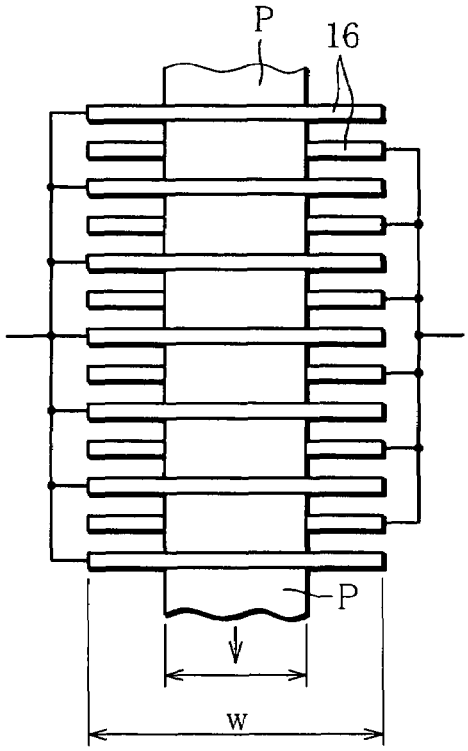
FIG. 4 is a side view showing the arrangement of the electrode pairs in the high-frequency dielectric heating device.

Specifically, the high-frequency dielectric heating device 13 according to the present embodiment is installed in a housing 18 formed as a box-shaped drying furnace in which the travel line for the wrapping paper P is formed therein in the shape of the letter U. The electrode pairs 16 constructing a main body of the high-frequency dielectric heating device 13 are arranged so that four groups are disposed in two rows and two upper and lower columns along the U-shaped travel line for the wrapping paper P. For example, as illustrated in FIG. 3 showing a front view of schematic arrangement, and as illustrated in FIG. 4 showing a side view thereof, each of the electrode pairs 16 is arranged so that a plurality of round rod-like electrodes 16*a* each having a length of about 15 cm are parallel to each other over a length of about 60 cm at a distance (pitch) of about 30 mm. The electrodes 16*a* are disposed opposite each other at a distance of about 5 to 8 mm with the wrapping paper P interposed therebetween, thereby forming the electrode pairs 16.

The warm air blower 14 sends warm air (hot air) having a temperature of about 70 to 80 degrees centigrade, for example, into the inside of the housing (drying furnace) 18 of the high-frequency dielectric heating device 13. The warm air blower 14 acts to dehumidify and dry the inside of the housing 18 in consort with an exhaust fan 19 installed in an upper portion of the housing 18. Especially, the warm air blower 14 discharges the moisture, which is released from the wrapping paper P dried chiefly by the electrode pairs 16, outside the housing (drying furnace) 18 through the exhaust fan 19 without condensing the moisture. Because of this moisture exhaust function of the warm air blower 14, the housing (drying furnace) 18 is suppressed from being humidified, and an intentional electric discharge between the electrode pairs 16 is prevented.

Reference mark 20 in the figure denotes an electric discharge sensor that is installed in the housing (drying furnace) 18. The electric discharge sensor 20 acts to detect flashes (ultraviolet rays) emitted with a spark electric discharge between the electrode pairs 16, and to stop the operation of drying the wrapping paper P, which is carried out by the high-frequency dielectric heating device 13. The application controller 11 detects a production rate (hoisting speed) of cigarettes in the hoist 1 from the number of rotations of the main spindle 1*a*, thereby controlling a discharge rate of the aroma chemical discharged from the application nozzle 12 according to the hoisting speed. Due to the control of the discharge rate of the aroma chemical, which is conducted by the application controller 11, an application amount of the aroma chemical with respect to the wrapping paper P per unit length is controlled to be constant.

In the cigarette manufacturing apparatus thus constructed, when the wrapping paper P wound around the roll is continuously supplied to the hoist 1 while being wound off from the roll, the wrapping paper P is provided to the cigarette production performed by the hoist 1 on line after being applied with the aroma chemical by the aroma chemical applicator 3 interposed in the supply path thereof. The wrapping paper P applied with the aroma chemical is provided to the cigarette production carried by the hoist 1 after being dried by a dielectric heating operation using the high-frequency dielectric heating device 13 as described.

Since the wrapping paper P applied with the aroma chemical is subjected to the high-frequency dielectric heating by the electrode pairs 16, the moisture that has infiltrated into the inside of the wrapping paper P after the application of the aroma chemical is evaporated due to self-heating. Accordingly, there occurs no such problem that the surface side of the wrapping paper P is heated much as in a conventional drying operation using radiant heat, and the inside of the wrapping paper P is poorly dried. Moreover, there generates no such problem that the wrapping paper P is scorched by excessive emission of moisture as in a dielectric heating operation that uses microwaves with strong energy.

The present inventors and the like prepared an aroma chemical A of 24 percent concentration by weight and an aroma chemical B of 35 percent concentration by weight which were diluted with solution of 1.7 percent of CMC (carboxymethyl cellulose), and applied these aroma chemicals A and B to thick wrapping paper (so-called Lucia wrapping paper) and thin wrapping paper (so-called 4P-35 wrapping paper), thereby conducting the following drying experiment.

First, the wrapping paper P applied with the aroma chemical A and that with the aroma chemical B were radiant-heated using a halogen lamp and/or rod heater used for drying seam glue. In this case, each piece of the wrapping paper P could not be fully dried and remained in so-called a half-dried state. In addition, each piece of the wrapping paper P was stained due to tobacco shreds attached to an aroma-chemical applied portion of the wrapping paper P in the half-dried state.

Using a waveguide-type furnace (magnetron) of a frequency of 2450 MHz and an output of 1.5 kW, the wrapping paper P applied with the aroma chemical A and that with the aroma chemical B were microwave-heated. In this case, frequent scorching suddenly occurs due to an electric discharge from the undried state. In the worst case, the wrapping paper P was burned. This phenomenon was attributable to the fact that the wrapping paper P was thin, and load upon microwaves is small. One solution is to narrow the strength of the microwaves radiated from the waveguide-type furnace (magnetron) in consideration of the load. However, there is a limit to the narrowing of strength of the microwaves radiated from the waveguide-type furnace. Accordingly, from a practical standpoint, to use the general-purpose waveguide-type furnace for drying the wrapping paper P is considered improper in terms of costs for equipment and the like.

At the same time, the wrapping paper P applied with the aroma chemical A and that with the aroma chemical B were dried by the high-frequency dielectric heating by means of the electrode pairs 16. In this case, it was ensured that the wrapping paper P could be dried almost satisfactorily without getting stained, although depending upon the cigarette production rate (hoisting speed) of the hoist 1. Furthermore, there generates no such problem as a wrapping paper jam in the hoist 1 and the like, attributable to twining of the wrapping paper that contains moisture. It was ensured that, especially when the aroma chemical B high in concentration was used, the wrapping paper P could be dried very effectively. The high concentration of the aroma chemical indicates low moisture content in the aroma chemical. Therefore, in the case of the aroma chemical B high in concentration, it can be considered that the wrapping paper P was small in dry load itself and was then easily dried. When the wrapping paper P applied with the aroma chemicals was subjected to the high-frequency dielectric drying as described above, the drying operation was carried out with warm air blown to between the electrode pairs 16. It was also ensured, if atmosphere in the housing (furnace) 18 was maintained in a dried state by doing as described above, a spark electric discharge between the electrode pairs 16 could be prevented without fail.

Figure 5:
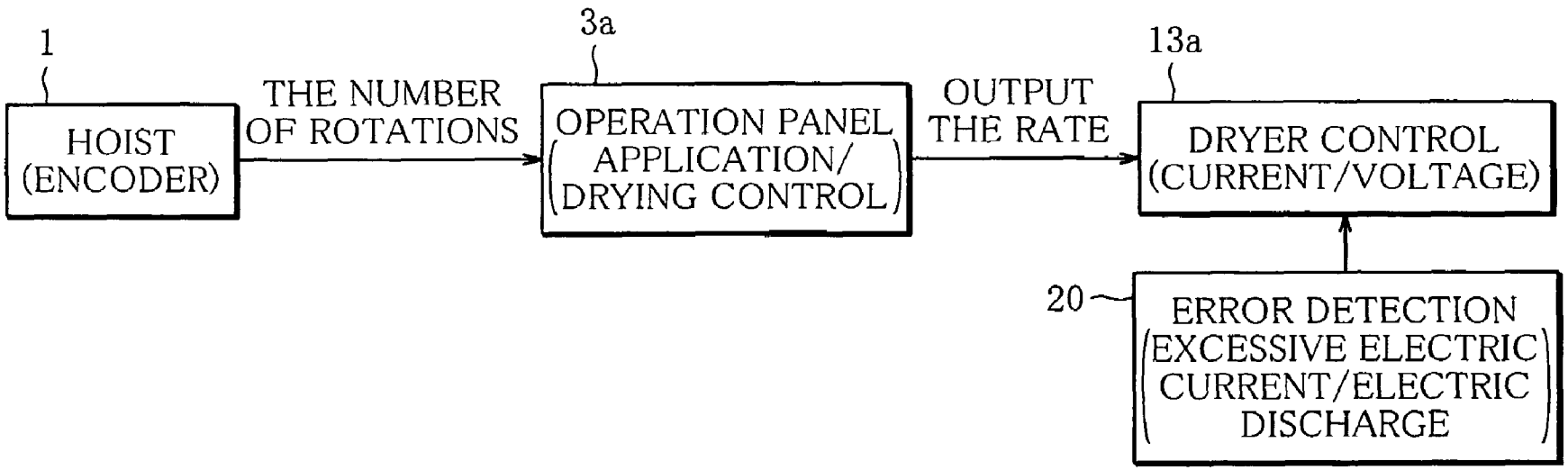
FIG. 5 is a view schematically showing a control system of the aroma chemical applicator.

Operation control of the aroma chemical applicator 3 constructed as mentioned above may be conducted according to information of the number of rotations (working speed) of the main spindle 1*a*, which is obtained from an encoder fixed to the main spindle 1*a* of the hoist 1, for example, as shown in FIG. 5. Specifically, using an operation panel 3*a* of the aroma chemical applicator 3, delivery speed of the wrapping paper P may be controlled according to the production rate (hoisting speed) of cigarettes in the hoist 1, which is obtained as described above, and simultaneously the application amount of the aroma chemical from the application nozzle 12 with respect to the wrapping paper P may be controlled. The wrapping paper P applied with the aroma chemical may be dried at proper strength by providing the information of the delivery speed of the wrapping paper P to a controller 13*a* of the high-frequency dielectric heating device 13 and controlling high-frequency voltage applied to the electrode pairs 16 and anode current thereof according to the deliver speed of the wrapping paper P. In this connection, in the controller 13*a*, when an error is detected by the electric discharge sensor 20 or the like, it is preferable that a burning accident of the wrapping paper P be prevented by stopping the drying operation or the like according to the error state.

Figure 6:
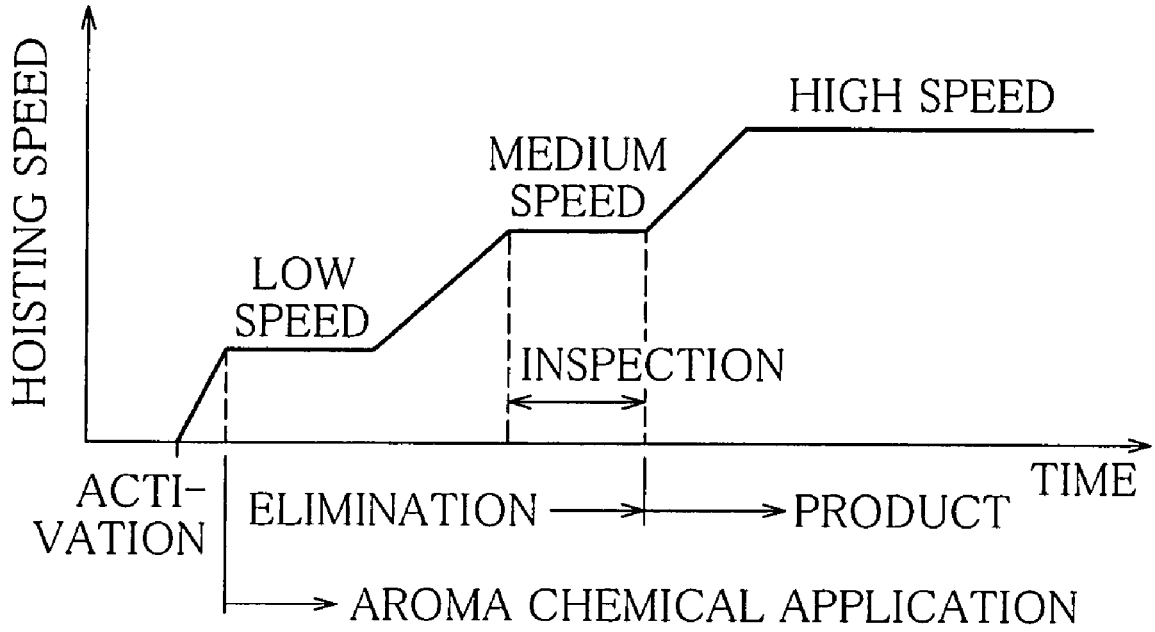
FIG. 6 is a view for explaining a control pattern of the aroma chemical applicator at the time when the cigarette manufacturing apparatus is activated.

When the cigarette manufacturing apparatus is activated (started up), as shown in FIG. 6, the hoist 1 is first operated at low speed as an initial step. According to the speed, the application of the aroma chemical to the wrapping paper P is started. Subsequently, operation speed of the hoist 1 is increased up to a medium speed range. In this state, an application condition and a drying condition of the aroma chemical are inspected. After it is confirmed that the application of the aroma chemical is satisfactorily performed, the operation speed of the hoist 1 may be increased up to a prescribed high speed range. It is a matter of course that, in the above-stated process, a discharge rate of the aroma chemical from the application nozzle 12 is varied according to the operation speed of the hoist 1, and that the application amount of the aroma chemical with respect to the wrapping paper P per unit length is controlled to be constant. Needless to say, the conditions of the high-frequency dielectric heating of the wrapping paper P, which is carried out by the high-frequency dielectric heating device 13, may be controlled as mentioned above.

As described above, with the cigarette manufacturing apparatus according to the present invention, when the wrapping paper P is applied with the aroma chemical having high moisture content, and simultaneously the wrapping paper P applied with the aroma chemical is dried and continuously supplied to the hoist 1 to be provided to the cigarette production, the high-frequency dielectric heating device 13 that subjects the wrapping paper P to the high-frequency heating by using the electrode pairs 16 applied with high-frequency voltage is used, so that it is possible to dry the wrapping paper P very well.

Because of the simple control, that is, the regulation of the voltage between electrodes and the anode current, it is possible to regulate the drying performance, so that controllability is excellent. Moreover, since extra moisture emitted (evaporated) from the wrapping paper P is eliminated through the drying operation to dehumidify the inside of the heating device 13 by sending warm air to the inside of the high-frequency dielectric heating device 13, an accidental electric discharge between the electrode pairs 16 can be prevented. Accordingly, there is provided a significant practical advantage that the high-frequency dielectric heating device 13 is stably operated to dry the wrapping paper P stably and efficiently, and the like.

The present invention is not limited to the above embodiments. For instance, the size (width) of the electrode pairs 16 is not limited as long as it corresponds to the width of the wrapping paper P. The length thereof may be determined by drying time, the length of a drying path, and the like, which are determined by a moisture content to be dried. The frequency of the high-frequency voltage that is applied to between the electrode pairs 16 is sufficient if it falls in a range of from 10 to 100 MHz in general. The level of the high-frequency voltage may be determined by specifications required to the drying operation of the wrapping paper P. In addition, the present invention may be modified in various ways without deviating the gist thereof.

The invention claimed is:

1. A cigarette manufacturing apparatus comprising:

a hoist that bends long wrapping paper in a width direction and continuously wraps tobacco shreds; a wrapping paper supplying device that continuously supplies the wrapping paper to the hoist; an applicator that is interposed in a wrapping paper supply path between the wrapping paper supplying device and the hoist and applies an aroma chemical to the wrapping paper; a high-frequency dielectric heating device that is installed in the applicator and dries the wrapping paper applied with the aroma chemical; and a warm air blower that supplies warm air to the inside of the high-frequency dielectric heating device and dehumidifies the inside of the heating device.

2. The cigarette manufacturing apparatus according to claim 1, wherein the applicator includes an application nozzle for applying the wrapping paper with an aroma chemical diluted with CMC (carboxymethyl cellulose) solution, and a controller for controlling amount of the aroma chemical applied to the wrapping paper by the application nozzle, according to supply speed of the wrapping paper to the hoist.

3. The cigarette manufacturing apparatus according to claim 1, wherein the high-frequency dielectric heating device has one or more electrode pairs arranged opposite each other at a prescribed distance and applied with high-frequency voltage, and applies a high-frequency electric field to the wrapping paper introduced to between the electrodes to dielectrically heat the wrapping paper.

4. The cigarette manufacturing apparatus according to claim 3, wherein the electrode pairs are driven by being applied with a high-frequency voltage in a range of from 10 to 100 MHz.

* * * * *